US005951333A

United States Patent [19]

Gladd et al.

[11] Patent Number: 5,951,333

[45] Date of Patent: Sep. 14, 1999

[54] HINGED WIRE ROUTE PLATE

[75] Inventors: Joseph Howard Gladd, Cortland; Jeffrey Michael Hickox, Middlefield, both of Ohio

[73] Assignee: General Motors Corporation, Detroit, Mich.

[21] Appl. No.: 08/949,844

[22] Filed: Oct. 14, 1997

[51] Int. Cl.[6] ..... H01R 9/22

[52] U.S. Cl. ..... 439/713; 439/76.2

[58] Field of Search ..... 439/76.2, 402, 439/404, 719, 713, 731

[56] References Cited

U.S. PATENT DOCUMENTS

| | | | |
|---|---|---|---|
| 4,766,521 | 8/1988 | Pelletier | 439/142 |
| 5,114,356 | 5/1992 | Taybl et al. | 439/724 X |
| 5,791,933 | 8/1998 | Saka et al. | 439/404 |

FOREIGN PATENT DOCUMENTS

| | | | |
|---|---|---|---|
| 2 611 315 | 8/1988 | France | 439/404 |
| WO 092015127 | 9/1992 | United Kingdom | 439/404 |

*Primary Examiner*—Khiem Nguyen
*Attorney, Agent, or Firm*—Cary W. Brooks; Patrick M. Griffin

[57] ABSTRACT

The invention includes a product and process involving a routed wire plate subassembly designed to utilize conventional routing of wire onto the subassembly and thereafter allows for bending of the subassembly to accommodate packaging needs. The end product can be formed by providing first and second wire route plate sets pivotally connected together. Each plate set has at least a top surface with wire receiving channels and passages formed therein. Wire is deposited into the wire receiving channels and passages and at least one wire extends across a portion of the top surface of both sets of plates. Terminals are stitched into terminal slots formed through either or both of the plates so that the terminal makes connection to a selected wire as desired. Thereafter, one of the plates is pivoted with respect to the other to a final location that meets the packaging needs for the wire routed plate subassembly.

5 Claims, 4 Drawing Sheets

HINGED WIRE ROUTE PLATE

TECHNICAL FIELD

This invention relates generally to wire route plates, and more particularly to a bent wire route plate subassembly which may be used in an electrical distribution center.

BACKGROUND OF THE INVENTION

Electrical distribution centers having wire route plates are widely used in automobiles. The electrical distribution center is simply a central junction block system designed as a stand-alone assembly. This junction block can package various fuses, relays and electronic devices in a central location. The electrical distribution centers not only reduce cost by consolidating these various functions into one block, but they also reduce the number of cut and splice leads which helps to increase reliability. Due to the increase in electrical content in automobiles, the electrical distribution centers are becoming larger. At the same time, increased content of other components in the automobile has limited the available space for locating the electrical distribution centers. To date, most of the wire route plates have been flat and thus have limited packaging ability. Heretofore, options for bending the wire route plates included flexible circuits and header connections that add substantially to the system cost. Thus, it would be desirable to develop a low cost wire route plate design that allows for bending to accommodate packaging needs in today's confined automotive compartments.

The present invention provides advantages over and alternatives to the prior art.

SUMMARY OF THE INVENTION

The invention includes a product and process involving a routed wire plate subassembly designed to utilize conventional routing of wire onto the subassembly and thereafter allows for bending of the subassembly to accommodate packaging needs. The end product can be formed by providing first and second wire route plate sets pivotally connected together. Each plate set has at least a top surface with wire receiving channels and passages formed therein. Wire is deposited into the wire receiving channels and passages and at least one wire extends across a portion of the top surface of both sets of plates. Terminals are stitched into terminal slots formed through either or both of the plates so that the terminal makes connection to a selected wire as desired. Thereafter, one of the plates is pivoted with respect to the other to a final location that meets the packaging needs for the wire routed plate subassembly.

In one embodiment of the invention, the first and second wire routing plate sets are hinged together by a pivot rod extending from one of the plates and received in a recess formed in the other plate. Wire separation ribs extend from the body portion of the first plate. During the wire routing process, additional wire is deposited in the gap provided between adjacent wire separation ribs so that when the plate sets are pivoted, the wire can be bent around a corner of the first plate set without breaking the wire.

These and other objects, features and advantages of the present invention will become apparent from the following brief description of the drawings, detailed description, and appended claims and drawings.

DESCRIPTION OF THE PREFERRED EMBODIMENT

Figure 1:
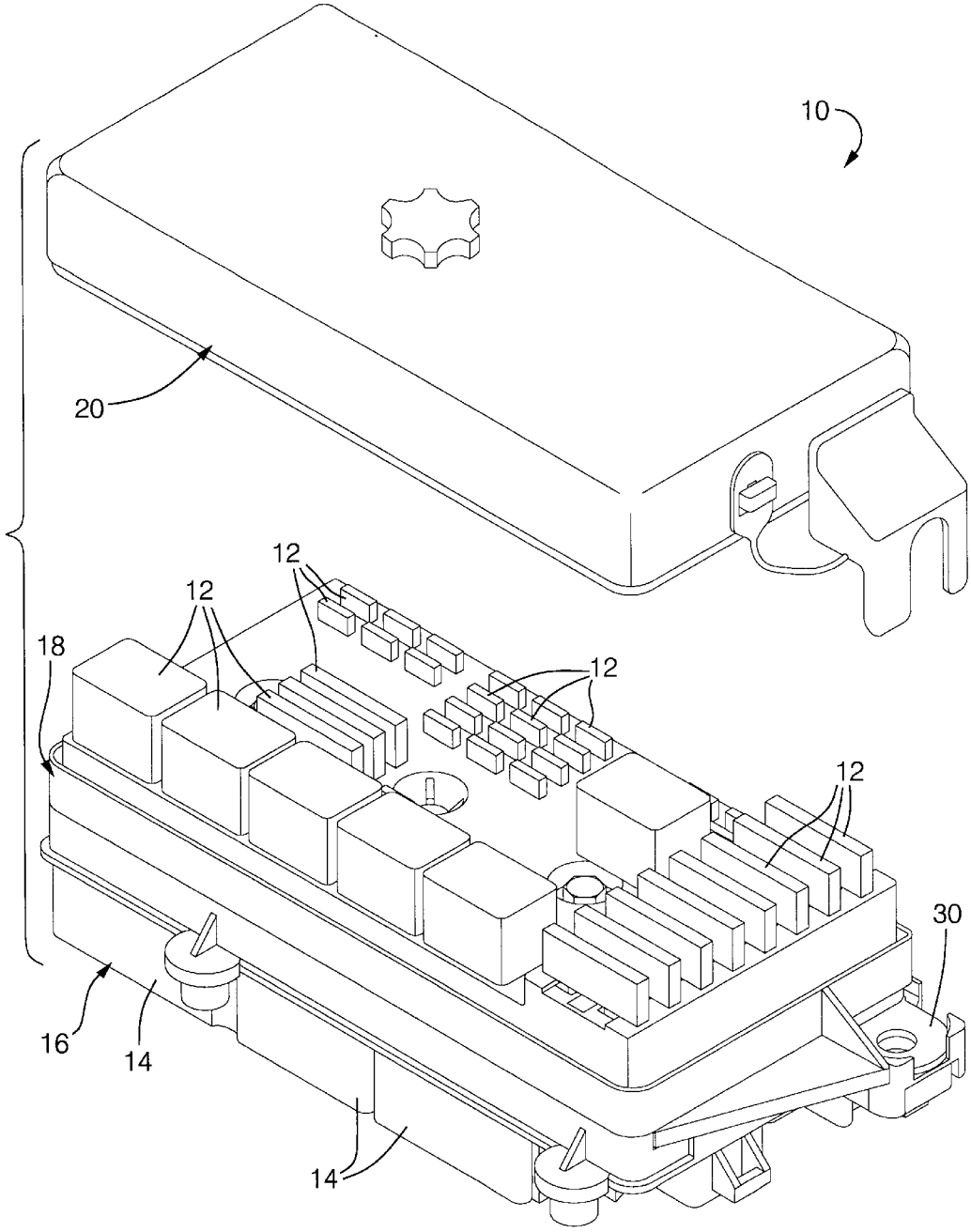
PRIOR ART FIG. 1
FIG. 1 is a perspective view of a prior art electrical distribution center with the cover shown in a raised position to illustrate electronic and electrical components that are plugged into the electrical distribution center.

FIG. 1 illustrates a prior art electrical distribution center 10 that provides an electrical interconnect between electrical and electronic devices 12 such as mini-fuses, maxi-fuses and relays that are plugged into the top of the electrical distribution center and the electrical connectors of wire harnesses that are plugged into a plurality of connector sockets 14 in the bottom housing 16 of the electrical distribution center 10.

The electrical distribution center typically includes the housings 16, 18 and a cover 20 that are molded from a thermal plastic electrically insulative material. The housings are comprised of a lower housing 16 and an upper housing 18 which fit together. The connector sockets 14 for receiving electrical connectors of the wire harness utilized in automotive applications can be molded as an integral part of the lower housing. Mini-fuses, maxi-fuses, devices and relays 12 can be plugged into terminal cavities 22 (FIG. 2) in the upper housing 18 and held in place by the cover 20 when the cover is attached to the housing. Such an arrangement is described in U.S. Pat. No. 5,023,752 that was granted to Gary C. Detter et al Jun. 11, 1992 for an Electrical Power Distribution Center, the disclosure of which is hereby incorporated by reference.

Figure 2:
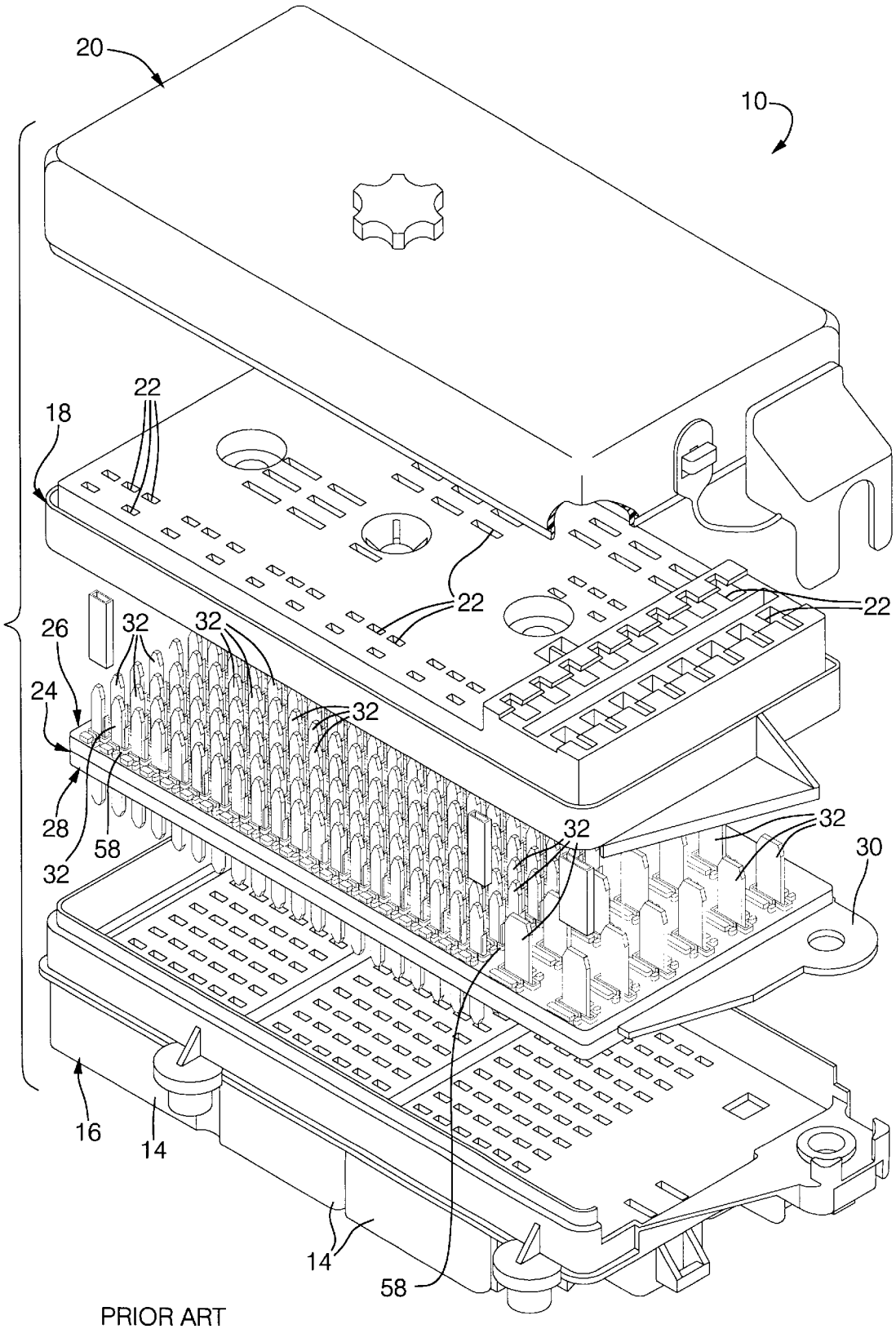
PRIOR ART FIG. 2
FIG. 2 is an exploded, perspective view of an electrical distribution center shown in FIG. 1.

The electrical distribution center includes several components that are disposed within the housing as will be appreciated from FIG. 2. This includes a two-piece main insulation assembly 24 having upper 26 and lower halves 28 that are flat and not bendable. A main stamped metal buss plate 30 may be carried within the main insulation assembly as well as a plurality of other stamped metal circuit components 32 which are press-fit into upper and lower halves of the main insulation assembly in a predetermined pattern. A variety of different types of stamped metal circuit components 32 are usable in the current invention. In general, each of these types of stamped metal circuit components include a male blade terminal or a tuning fork terminal that protrudes outwardly from the main insulation assembly. The main stamped metal buss circuit 30 comprises a flat planar body that is carried in a gap between the upper and lower insulation plate halves 26, 28 for interconnecting a plurality of male blade terminals or tuning fork terminals 32 that are perpendicularly attached at the edge of the body. These male blade or tuning fork terminals may be bent upwards to protrude through and above the upper half of the insulation assembly or bent downward to protrude through and below the lower half of the insulation assembly. Further, the male blade or tuning fork terminals may extend in the same or in opposite directions, whereby the connecting flat portion of the stamped metal circuit can include any shape (e.g., U-shaped or Z-shaped) when viewed from an end as is known to those skilled in the art and not shown in the drawings. In any event, the main buss plate comprises one or more stamped metal circuit components having male blade or tuning fork terminals arranged in a predetermined pattern and maintained in this predetermined pattern by the two-piece insulation assembly. The stamped metal circuit components have a relatively high current capacity and thus are adequate for even the highest current normally encountered in automotive wire circuits, i.e., up to about 40 amps continuous current. This is especially necessary for the main stamped metal circuit component that is a power buss and includes an ear portion for connection to a battery cable and high capacity male blades or tuning fork terminals for connection to maxi-fuses. However, this prior art electrical distribution center is flat and thus has limited packaging ability.

Figure 3:
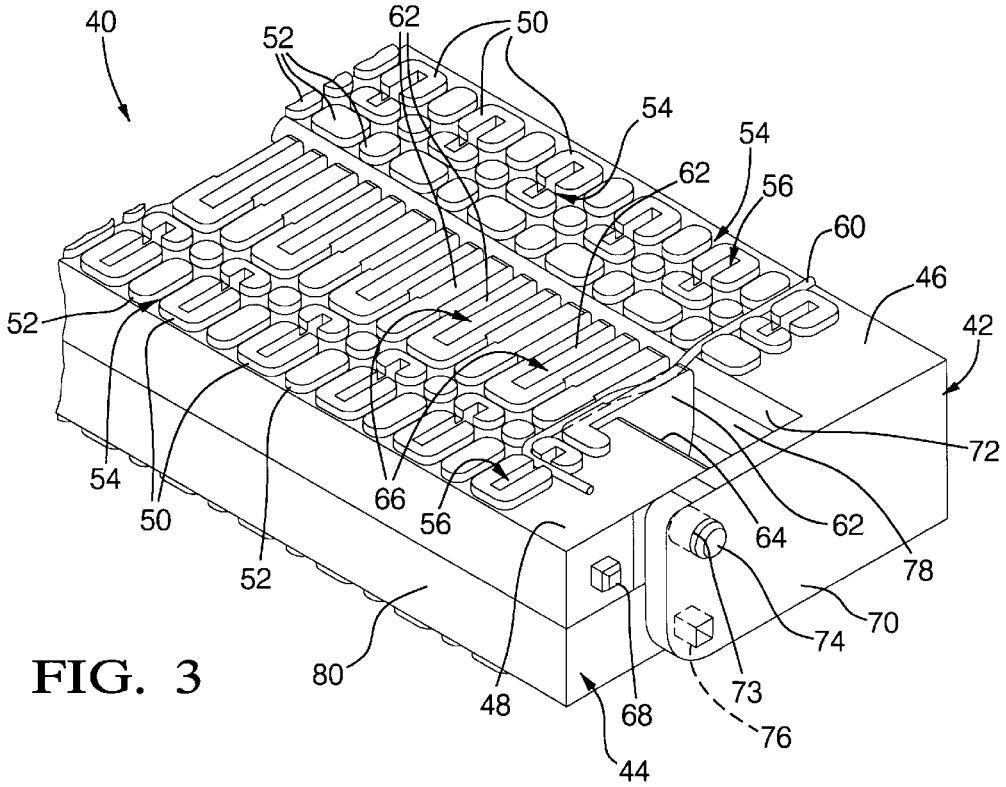
FIG. 3 is an illustration of the hinged wire route plate assembly according to the present invention in a flat configuration.

According to the present invention, the hinged wire route plate subassembly 40 illustrated in FIG. 3 may be used in an electrical distribution center as a substitute for the two-piece main installation assembly 24 shown in FIGS. 1-2 and that has upper 26 and lower halves 28 that are flat and not bendable. Further, the hinged wire route plate system illustrated in FIGS. 3–5 may be utilized in applications other than electrical distribution centers. In any event, the hinged wire route subassembly 40 includes a first plate set 42 and a second plate set 44 that are pivotally connected together. Each plate set 42, 44 includes at least a top wire route plate 46, 48 respectively. Each of the top wire route plates 46, 48 includes a plurality of raised features such as terminal stations 50 and guide stations 52 which define a network of wire channels 54 in a predetermined pattern. The terminal station 50 includes a slot 56 for receiving a metal terminal and a wire channel 54 may be provided through the terminal station. The terminal 32 may include a male blade or tuning fork portion and a spaced apart terminal finger 58 as shown in FIGS. 1-2. A wire 60 may be deposited in the wire channels 54 and through the terminal station and between the tuning fork portion, or the male blade and the spaced apart terminal finger 58. The top plate 48 of the second wire route plate set includes a plurality of spaced apart wire guide ribs 62 extending from an edge 64 of the top plate 48. A gap 66 is provided between the spaced apart guide ribs 62 for receiving the wire 60 extending between the two top plates 46, 48.

Figure 4:
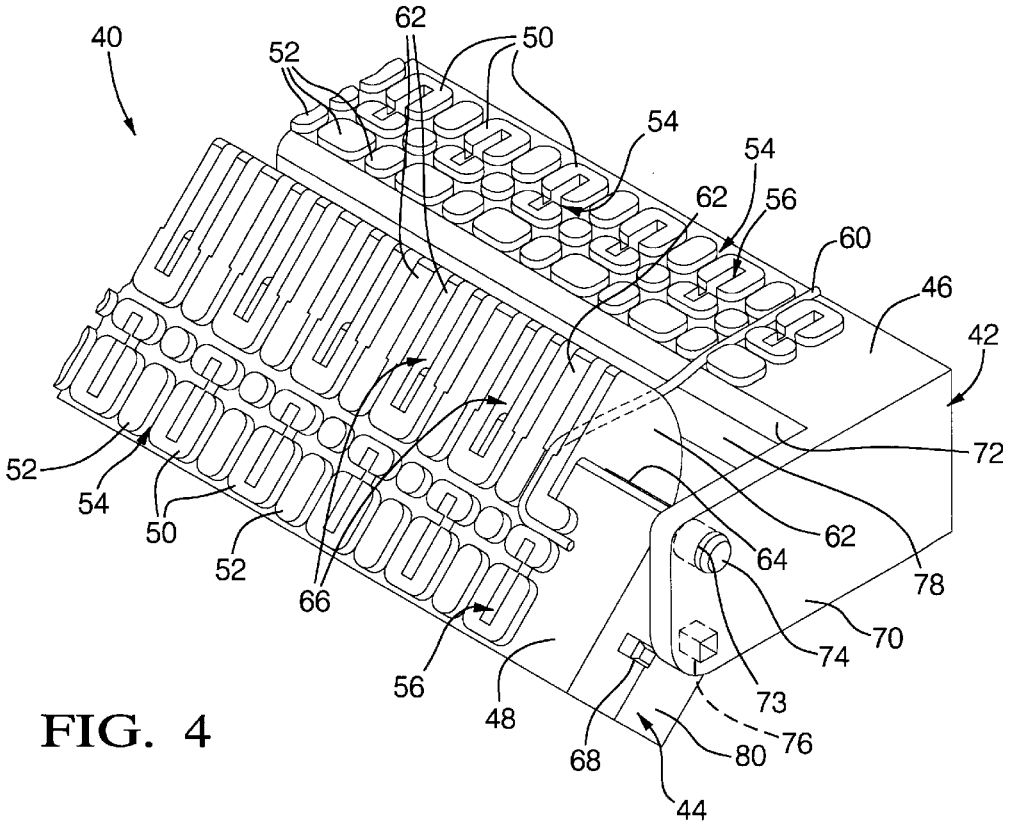
FIG. 4 is an illustration of the hinged wire route plate assembly according to the present invention in a bent position.

For assembly, the first and second wire route plate sets 42, 44 are pivotally connected together and mounted in a wire route nest. The subassembly 40 is routed with wire traces 60 deposited in the wire channels 54 provided between and through the terminal stations 50 and guide stations 52. A suitable wire routing machine and process is described in VanZeeland et al, U.S. Pat. No. 5,482,092, the disclosure of which is hereby incorporated by reference. When the wire routing machine reaches the edge 64 of the top plate 48 of the second plate set, additional wire is paid out or deposited into the gap 66 provided between the wire guide ribs 62 so that the wire sags into the gap as shown in FIG. 3. The terminals 32 illustrated in FIG. 2 are stitched into the routed subassembly through the terminal slots 56. After the routing process has been completed, the hinged wire routed subassembly 40 is placed into a bend fixture to accurately bend the hinged plate sets with a controlled action. The fixture may be constructed and arranged so that a clamp is provided on the routed wires 60 during the bending action to assure that the wires 60 do not pull out of the wire route channels 56. As the assembly is bent as shown in FIG. 4, the wire guide ribs 62 insure that the wire 60 is properly aligned during the bending action and so that the wire snugly engages the edge 64 of the top plate 48 of the second plate set. Preferably the front edge 64 of the top plate 48 has a rounded configuration. The hinged wire route plate subassembly 40 may be bent so that the upper surface of the top plates 46, 48 are pivoted at an angle with respect to each other, such as, an angle of 10 degrees, 20 degrees, 30 degrees, 45 degrees or 90 degrees and so on, and to a final position as illustrated in FIG. 5.

Figure 5:
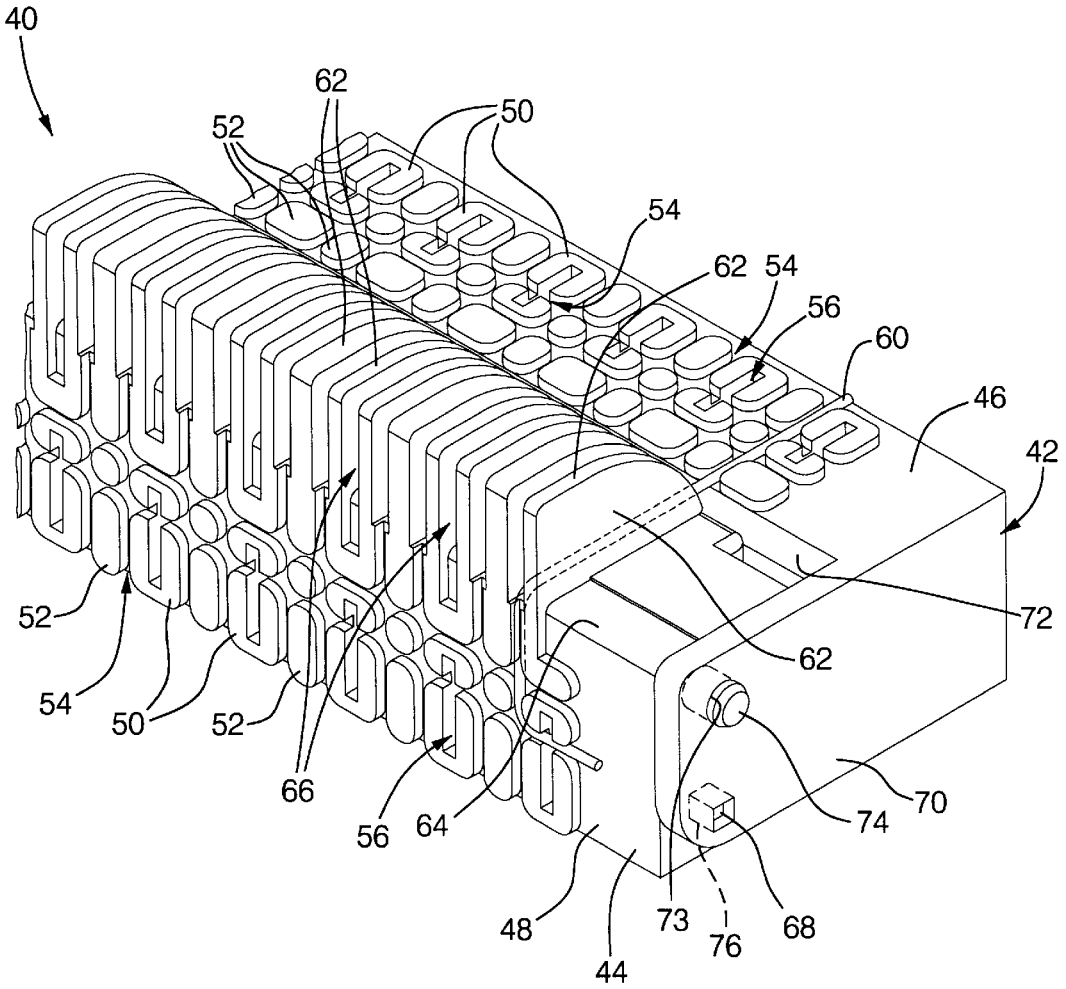
FIG. 5 is an illustration of a hinged wire route plate assembly in a final bent and locked position according to the present invention.

In a preferred embodiment illustrated in FIGS. 3–5, an arm 70 extends outwardly from an edge 72 of the top plate 46 of the first plate set and includes an aperture 73 formed therethrough for receiving a pivot rod 74 extending from the top plate 48 of the second plate set. Preferably a pair of arms 70 are provided with each extending from the top plate 46 near sides thereof. The routed wire route plate subassembly 40 may be latched in a final position shown in FIG. 5 by any of a variety of locking mechanisms, including a lock nub 68 extending from the top plate 48 of the second plate set and being received in a recess 76 provided in the arm 70 that extends from the top plate 46 of the first plate set.

Bottom plates 78, 80 may be provided for each of the first and second plate sets 42, 44 respectively. The bottom plates 78, 80 may also be configured with terminal stations 50 and guide stations 52 defining wire channels 56 for receiving the routed wire 60 in a manner similar to the top plates 46, 48.

The present invention provides a simple economic solution to the packaging problem associated with prior art flat wire routed plates. The present invention provides a hinged wire route plate subassembly that is designed for conventional wire routing and allows the subassembly to be thereafter bent to accommodate packaging needs. The bending is accomplished with a simple design and without the need for expensive and complicated connectors or flexible circuits.

We claim:

1. A wire route plate subassembly comprising:

first and second wire route plate sets pivotally connected together, each of the plate sets including a top plate having a plurality of spaced apart raised features including terminal stations, the raised features defining wire channels therebetween for receiving a routed wire, one of the top plates including a plurality of wire guide ribs extending from an edge of the top plate, at least one wire received in a wire channel of each of the plate sets and bridging the top plates of the first and second plate sets and extending through a gap between spaced apart wire guide ribs, the wire guide ribs extending outwardly of the edge of the top plate enough so that the one wire sags in the gap when the top plates are in a flat configuration.

2. A wire route plate subassembly as set forth in claim 1 further comprising an arm extending from the top plate of the first plate set and having a recess formed therein for receiving a pivot rod extending from the top plate of the second plate set.

3. A wire route plate subassembly as set forth in claim 1 wherein the first and second plate sets are selectively lockable in a final assembled position.

4. A wire route plate subassembly comprising:

first and second wire route plate sets pivotally connected together, each of the plate sets including a top plate having a plurality of spaced apart raised features including terminal stations, the raised features defining wire channels therebetween for receiving a routed wire, one of the top plates including a plurality of wire guide ribs extending from an edge of the top plate, at least one wire received in a wire channel and bridging the top plates of the first and second plate sets and extending between spaced apart wire guide ribs, wherein the first and second plate sets are selectively lockable in a final assembled position and wherein one of the first and second plate sets includes a lock nub extending therefrom and the other of the first and second plate sets includes an associated recess for receiving the lock nub and locking the plate sets in a final position.

5. A wire route plate subassembly comprising:

first and second wire route plates pivotally connected together, each plate having a top surface having a plurality of spaced apart raised features including terminal stations, the raised features defining wire channels therebetween for receiving a routed wire, one of the plates including a plurality of wire guide ribs extending from an edge of the plate, at least one wire received in a wire channel of each of the plates and bridging the top surface of the plates and extending through a gap between spaced apart wire guide ribs the wire guide ribs, extending outwardly of the edge of one of the plates enough so that the one wire sags in the gap when the plates are in a flat configuration.

* * * * *